United States Patent [19]

Sharp

[11] 4,356,951

[45] Nov. 2, 1982

[54] POURING SPOUT CARTON

[75] Inventor: David Sharp, Toronto, Canada

[73] Assignee: Ford Printing & Packaging Ltd., Don Mills, Canada

[21] Appl. No.: 268,711

[22] Filed: May 28, 1981

[51] Int. Cl.[3] ..... B65D 5/72; B65D 39/00

[52] U.S. Cl. ..... 229/17 R; 229/7 R

[58] Field of Search ..... 229/17 R, 7 R; 221/303, 221/307

[56] References Cited

U.S. PATENT DOCUMENTS

| | | | |
|---|---|---|---|
| 1,756,150 | 4/1930 | Ganz | 229/7 R |
| 2,338,260 | 1/1944 | Ringler | 229/17 R |
| 2,475,677 | 7/1949 | Ringler | 229/17 R |
| 2,509,289 | 5/1950 | Dunning | 229/17 R |
| 2,842,302 | 7/1958 | Ryder | 229/17 R |
| 3,131,847 | 5/1964 | Desmond | 229/17 R |
| 3,133,688 | 5/1964 | Asman | 229/17 R |
| 3,404,828 | 10/1968 | Whipperman | 229/17 R |
| 3,692,227 | 9/1972 | Hennessey | 229/17 R |
| 3,767,553 | 2/1973 | Frameir | 229/7 R |
| 3,982,683 | 9/1976 | Farteau | 229/17 R |

FOREIGN PATENT DOCUMENTS

| | | | |
|---|---|---|---|
| 613860 | 12/1948 | United Kingdom | 229/17 R |

*Primary Examiner*—Herbert F. Ross

*Attorney, Agent, or Firm*—Ridout & Maybee

[57] ABSTRACT

A carton comprises opposite normally flat side panels, a normally flat transverse panel joined to the side panels along one edge of each of the side panels, an upper spout edge which is closed along a line cut across the transverse panel and angled downwardly in the side panels to first opposed flexure points in the side panels, a lower spout edge scored across the transverse panel, below the upper spout edge and angled upwardly in the side panels to the first flexure points, the lower spout edge intersecting each said edge of the side panels at said flexure points, and a score line extending from each of the first flexure points angularly downwardly to third flexure points at each said edge of the side panels below the second flexure points, the transverse panel thus providing, between the third flexure points and the lower spout edge, a trigger surface that can be pressed to swing inwardly of the carton about the third flexure points, forcing the lower spout edge and the second flexure points inwardly, and the side panels to bulge outwardly at the first flexure points, until the second flexure points lie in a common plane with the other flexure points, after which further inward movement of the trigger panel is assisted by pressure from the outwardly bulged side panels, whereby the second flexure points are urged farther inwardly and the upper spout edge is urged to extend outwardly by the pressure from the bulged side panels and the spout is held open. A carton blank is adapted to be erected into a such carton having an openable and recloseable pouring spout.

7 Claims, 3 Drawing Figures

POURING SPOUT CARTON

FIELD OF THE INVENTION

This invention relates to a carton having an openable and recloseable pouring spout integral therewith and to a carton blank therefor.

BACKGROUND OF THE INVENTION

Scored carton blanks and cartons selected therefrom to have an openable and recloseable pouring spout are well known. However, many known designs have one or more of the following disadvantages. In some, extra parts are added to provide a pouring spout. Others have required an initial setting up operation. In some, continuous pressure is required to maintain the spouring spout in the open position. Still others require an awkward pulling action to open or reclose the pouring spout. Yet others provide a pouring spout in a corner between adjacent walls of the carton; this results in an awkward pouring motion through a relatively small opening.

SUMMARY OF THE INVENTION

According to the present invention an integral openable and recloseable pouring spout is provided in a transverse panel, and the spout is easily openable and recloseable by means of a manual pushing action.

More particularly, according to the present invention there is provided a carton comprising opposite normally flat side panels, a normally flat transverse panel joined to the side panels along one edge of each of the side panels, an upper spout edge which is closed along a line cut across the transverse panel and angled downwardly in the side panels to first opposed flexure points in the side panels, a lower spout edge scored across the transverse panel, below the upper spout edge and angled upwardly in the side panels to the first flexure points, the lower spout edge intersecting each said edge of the side panels at second flexure points, and a score line extending from each of the first flexure points angularly downwardly to third flexure points at each said edge of the side panels below the second flexure points, the transverse panel thus providing, between the third flexure points and the lower spout edge, a trigger surface that can be pressed to swing inwardly of the carton about the third flexure points, forcing the lower spout edge and the second flexure points inwardly, and the side panels to bulge outwardly at the first flexure points, until the second flexure points lie in a common plane with the other flexure points, after which further inward movement of the trigger panel is assisted by pressure from the outwardly bulged side panels, whereby the second flexure points are urged farther inwardly and the upper spout edge is urged to extend outwardly by the pressure from the bulged side panels and the spout is held open.

There is also provided a carton blank adapted to be erected into a carton having an openable and recloseable pouring spout, said blank having a transverse panel disposed between two side panels and demarcated from each of them by vertical fold lines, a horizontal cut across the transverse panel, a downwardly angled cut in each of the side panels, each angled cut extending from an intersection of said horizontal cut with a first fold line to a first flexure point in the side panel, a horizontal score line extending across the transverse panel below said horizontal cut between second flexure points at each of the fold lines, an angled score line in each of the side panels extending upwardly from one of the second flexure points to one of the first flexure points, and a downwardly angled score line in each of said side panels extending from one of the first flexure points to a third flexure point in one of the fold lines, the third flexure points being below the second flexure points, the pouring spout being defined by said cuts, horizontal score line and upwardly extending score lines, and, when the carton is erected, the spout being operable by pressing on the transverse panel below the horizontal score line but above the third flexure points.

BRIEF DESCRIPTION OF THE DRAWINGS

A preferred embodiment of the invention is illustrated in the drawings wherein.

Figure 1:
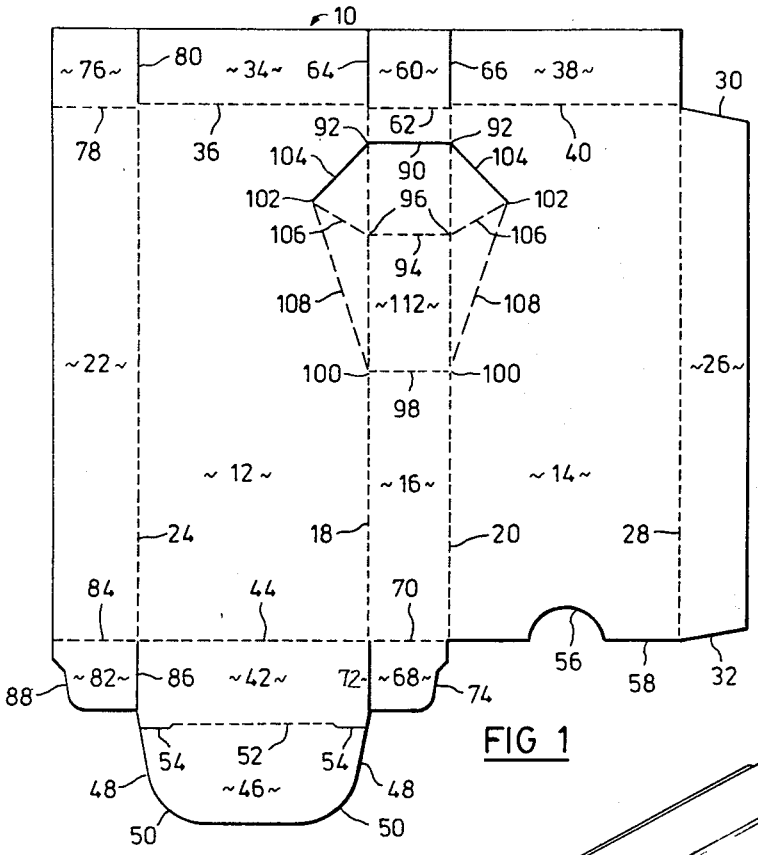
FIG. 1 is a plan view of a carton blank.

In the drawings, cut lines are denoted by solid lines, score lines are denoted by long dash lines and fold lines are denoted by short dash lines.

DESCRIPTION OF THE PREFERRED EMBODIMENT

In FIG. 1, a carton blank 10 is shown. The blank 10 has a first side panel 12 and a second side panel 14 in spaced relation to each other. A central transverse panel 16 is disposed between the main panels 12, 14 and is demarcated therefrom by a pair of vertical fold lines 18, 20, which define the opposite edges of the central transverse panel 16 and one edge of each of the side panels 12, 14. Fold line 18 demarcates the first side panel 12 from the central transverse panel 16, while fold line 20 demarcates the second side panel 14 from the central transverse panel 16.

A second transverse panel 22 is disposed along the outer edge of the first side panel 12 and is demarcated therefrom by a fold line 24 which defines the inner edge of the second transverse panel 22 and the outer edge of the first side panel 12.

A third transverse panel 26 is disposed along the outer edge of the second side panel 14 and is demarcated therefrom by a fold line 28 which defines the inner edge of the third transverse panel 26 and the outer edge of the second side panel 14. The third transverse panel 26 is tapered away from fold line 28 along its top 30 and bottom 32 edges to facilitate fitting it, behind the second transverse panel 22 upon erection of the carton.

A first top closure panel 34 is disposed along the top edge of the first side panel 12 and is demarcated from the first side panel 12 by a fold line 36 defining the lower edge of the first top closure panel 34 and the upper edge of the first side panel 12. A second top closure panel 38 is disposed along the top edge of the second side panel 14 and is demarcated from the second side panel 14 by a fold line 40 defining the lower edge of the second top closure panel 38 and the upper edge of the second side panel 14.

A bottom closure panel 42 is disposed along the bottom edge of the first side panel 12 and is demarcated from the first side panel 12 by a fold line 44 defining the upper edge of the bottom closure panel 42 and the lower edge of the first side panel 12. Disposed along the bottom edge of the bottom closure panel 42 is a closure extension tab 46 whose outer sides 48 are tapered and whose lower corners 50 are rounded. The closure extension tab 46 is demarcated from the bottom closure panel 42 by a fold line 52 defining the upper edge of the closure extension tab 46 and the lower edge of the bottom closure panel 42. At the outer extremities of the fold line 52, cuts 54 are made to facilitate folding of the closure extension tab 46 into the carton upon erection.

A recess 56 is provided in the bottom edge 58 of the second side panel 14. The recess 56 is semi-circular and allows the insertion of a person's finger to reach the closure extension tab 46, when the carton is erected, to open the closure panel 42 and tab 46.

An upper central tab 60 is provided along the upper edge of the central transverse panel 16.

The panel 60 is demarcated from the central transverse panel 16 by a fold line 62 and from the top closure panels 34 and 36 by cuts 64 and 66, respectively. Fold line 62 is disposed slightly below fold lines 36 and 40.

A lower central tab 68 is disposed along the lower edge of the central transverse panel 16. The lower central tab 68 is demarcated from the central transverse panel 16 by a fold line 70 and from the bottom closure panel 42 by a cut 72. The lower central tab panel 68 has a recess 74 in the side opposite the cut 72 to facilitate fitting it behind the bottom closure panel 42 upon erection of the carton.

An upper outer tab 76 is disposed along the upper edge of the second transverse panel 22. The upper outer tab 76 is demarcated from the second transverse panel 22 by a fold line 78 and from the top closure panel 34 by a cut 80. The fold line 78 is disposed slightly below the fold line 36.

A lower outer tab 82 is disposed along the lower edge of the second transverse panel 22. The lower outer tab 82 is demarcated from the second transverse panel 22 by a fold line 84 and from the bottom closure panel 42 by a cut 86. The lower outer tab panel 82 has a recess 88 in the side opposite the cut 86 to facilitate fitting it behind the bottom closure panel 42 upon erection of the carton.

In the upper portion of the central transverse panel 16 is a horizontal cut 90 which extends the full width of the central transverse panel 16 and intersects the fold lines 18, 20 at points 92.

Below the horizontal cut 90 in the central transverse panel 16 is a score line 94 which extends the full width of the central transverse panel 16 and intersects the fold lines 18, 20 at points 96. At each point 96 there is a punch hole.

Below the horizontal score line 96 in the central transverse panel is a fold line 98 which extends the full width of the central transverse panel 16 and intersects the fold lines 18,20 at points 100.

Figure 2:
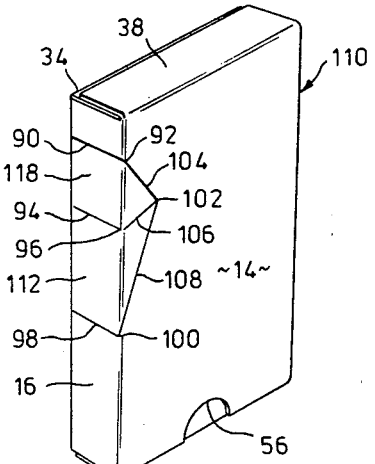
FIG. 2 is a perspective view of a carton erected from the blank of FIG. 1, with the pouring spout in the closed position.
Figure 3:
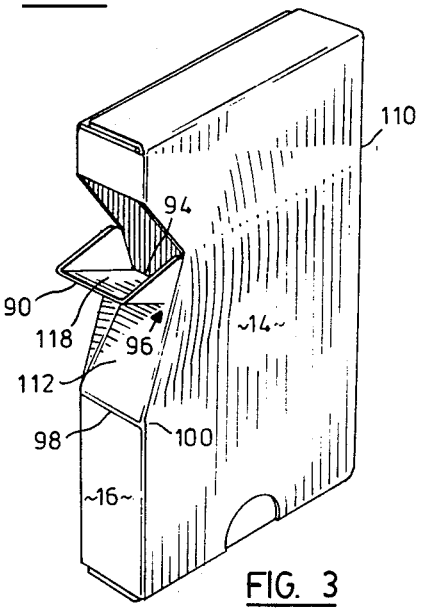
FIG. 3 is a perspective view of the erected carton with the pouring spout in the open position.

In each of the side panels 12, 14 are first opposed flexure points 102. The first flexure points 102 are below horizontal cut line 90 and above horizontal score line 94 and laterally spaced from the fold lines 18, 20. An angled cut line 104 extends between point 92 and first flexure point 102 in each of the side panels 12, 14. An angled score line 106 extends between second flexure point 96 and first flexure point 102 in each of the side panels 12, 14. Another angled score line 108 extends between third flexure point 100 and first flexure point 102 in each of the side panels 12, 14. The carton 110 is shown in FIGS. 2 and 3 as erected from the blank 10. Erection is accomplished by folding all panels and tabs inward along the various fold lines. The third transverse panel 26 is inserted behind the second transverse panel 22 and adhered thereto. The upper tabs 60, 76 are inserted below one top closure panel 34, and adhered thereto. The other one of the top closure panels 38 is folded over and adhered to the top closure panel 34 beneath it. The lower tabs 68, 82 are tucked behind the bottom closure panel 42. The closure extension tab 46 is then inserted behind the second side panel 14.

The surface 112 in the transverse panel 16, between the lines 94 and 98, constitutes a trigger surface. If finger pressure is applied to the trigger surface 112 to push it inwardly of the carton 110, the trigger surface 112 swings inwardly about the line 98 and the third flexure points 100. This forces the lower spout edge, constituted by the lines 94 and 106, to move into a common plane which contains the flexure points 100, 96 and 102, and this requires the side panels 12, 14 to bulge outwardly at the first flexure points 102, and causes the cut edge 90 to swing outwardly, with the edges 90 and 104 defining an upper spout edge. Further inward movement of the trigger surface 112, beyond the point where the flexure points are coplanar, is assisted by pressure from the outwardly bulged side panels, whereby the second flexure points 96 are urged farther inwardly, and the upper spout edge moves to the position shown in FIG. 3 where the pressure of the side panels 12, 14 holds the spout open without the need to maintain pressure on the trigger surface 112. The inward movement of the second flexure points 96 is facilitated by the punch holes. As the spout is opened by folding of the various panels, the carton adjacent the second flexure points 96 may tend to pack at the second flexure points 96. The punch holes at the second flexure points 96 enable the spout to move freely both inwardly and outwardly.

To reclose the spout, finger pressure can be applied by pushing inwardly on the spout edge 90. This forces the flexure points 102 apart against the inward pressure of the side panels until the flexure points 102, 96 and 100 are again in a common plane, after which the inward pressure in the spout is assisted by the upward pressure of the bulged side panels 12, 14 to restore the points to the position shown in FIG. 2 with the upper spout edge 90, 104 closed.

While a specific embodiment of this invention has been disclosed and illustrated herein, it is to be understood that variations and modifications are possible without departing from the spirit of this invention.

I claim:

1. A carton comprising opposite normally flat side panels, a normally flat transverse panel joined to the side panels along one edge of each of the side panels, an upper spout edge which is closed along a line cut across the transverse panel and angled downwardly in the side panels to first opposed flexure points in the side panels, a lower spout edge scored across the transverse panel, below the upper spout edge and angled upwardly in the side panels to the first flexure points, the lower spout edge intersecting each said edge of the side panels at second flexure points, and a score line extending from each of the first flexure points angularly downwardly to third flexure points at each said edge of the side panels below the second flexure points, the transverse panel thus providing, between the third flexure points and the lower spout edge, a trigger surface that can be pressed to swing inwardly of the carton about the third flexure points, forcing the lower spout edge and the second flexure points inwardly, and the side panels to bulge outwardly at the first flexure points, until the second flexure points lie in a common plane with the other flexure points, after which further inward movement of the trigger panel is assisted by pressure from the outwardly bulged side panels, whereby the second flexure points are urged further inwardly and the upper spout edge is urged to extend outwardly by the pressure from the bulged side panels and the spout is held open.

2. A carton as claimed in claim 1, wherein, with the upper spout edge extended outwardly, inward pressure applied to the upper spout edge forces the second flexure points of the side panels outwardly until the flexure points are again in said common plane, whereafter pressure from the bulged side panels can restore the transverse panel to its normally flat condition with the spout closed.

3. A carton as claimed in claims 1 or 2 wherein holes are punched at each of the second flexure points to facilitate opening and closing of the spout.

4. A carton as claimed in claim 1, wherein said third flexure points are joined by a score line across the transverse panel.

5. A carton blank adapted to be erected into a carton having an openable and recloseable pouring spout, said blank having a transverse panel disposed between two side panels and demarcated from each of them by vertical fold lines, a horizontal cut across the transverse panel, a downwardly angled cut in each of the side panels, each angled cut extending from an intersection of said horizontal cut with a first fold line to a first flexure point in the side panel, a horizontal score line extending across the transverse panel below said horizontal cut between second flexure points at each of the fold lines, an angled score line in each of the side panels extending upwardly from each of the second flexure points to respective of the first flexure points, and a downwardly angled score line in each of said side panels extending from each of the first flexure points to a third flexure point in each of the fold lines, the third flexure points being below the second flexure points, the pouring spout being defined by said cuts, horizontal score line and upwardly extending score lines, and, when the carton is erected, the spout being operable by pressing inwardly on the transverse panel below the horizontal score line but above the third flexure points.

6. A carbon blank as claimed in claim 5, wherein holes are punched at each of the second flexure points to facilitate opening and closing of the spout upon erection of the carton.

7. A carton blank as claimed in claim 5, wherein the third flexure points are joined by a score line across the transverse panel.

* * * * *